United States Patent [19]

Jones

[11] 4,146,286

[45] Mar. 27, 1979

[54] ELECTRICAL CONNECTION APPARATUS AND METHOD

[75] Inventor: Thomas C. Jones, Southfield, Mich.

[73] Assignee: Ford Motor Company, Dearborn, Mich.

[21] Appl. No.: 897,213

[22] Filed: Apr. 17, 1978

[51] Int. Cl.[2] ..... H01R 13/24

[52] U.S. Cl. ..... 339/48; 339/60 R; 339/126 RS; 339/61 R

[58] Field of Search ..... 339/4, 10, 48, 49 B, 339/59, 60, 61, 128, 126; 200/61.62, 61.7, 295

[56] References Cited

U.S. PATENT DOCUMENTS

| | | | |
|---|---|---|---|
| 3,125,371 | 3/1964 | Krueger | 49/13 |
| 3,384,862 | 5/1968 | Shroyer | 339/126 RS |
| 3,693,133 | 9/1972 | Harbonn et al. | 339/60 R |

FOREIGN PATENT DOCUMENTS

| | | | |
|---|---|---|---|
| 1008377 | 5/1957 | Fed. Rep. of Germany | 339/60 R |
| 1554320 | 12/1968 | France | 339/48 |
| 553570 | 5/1943 | United Kingdom | 339/60 R |

*Primary Examiner*—Neil Abrams

*Attorney, Agent, or Firm*—Peter Abolins; Keith L. Zerschling

[57] ABSTRACT

An electrical connector for making or breaking an electrical connection with, for example, another such relatively movable electrical connector, includes an electrically conductive contact supported by a resilient deformable support so that a force applied to the electrical contact causes deflection of the support and applies a biasing force to the conductive contact to resist movement in response to the applied force. Thus, the two contacts are pressed against each other to complete the electrical connection and the electrical connector provides a complete electrical circuit without the need for interlocking.

3 Claims, 5 Drawing Figures

ELECTRICAL CONNECTION APPARATUS AND METHOD

BACKGROUND OF THE INVENTION (1) Field of the Invention

This invention relates to controlling an electrical circuit and, more particularly, to a connector means for selectively completing and interrupting an electrical circuit in accordance with the position of the connector means.

(2) Prior Art

Various means are know for selectively completing an electrical circuit between two relatively movable components. For example, mechanical connectors which interlock with respect to each other are known. A disadvantage of such interlocking connectors is that manufacturing variations are not readily tolerated because of the need for relatively precise alignment between the two interlocking parts. Further, such interlocking parts wear against each other which may cause them to malfunction. As a result, the failure of the connector causes all devices controlled by the connector to be inoperative and thus prevents use of such devices.

The prior art also teaches the operation of a switch which is actuated or deactuated in response to deflection of a switching member by another member. For example, a station wagon can include a switch mounted in the tailgate of a station wagon. As the tailgate is moved between an open and a closed position, a movable electrical contact is deflected between a first position when the tailgate is closed and a second position when a tailgate is open. Although an electrical circuit can be completed or interrupted, such a circuit controller is undesirable because its relative complexity makes it more expensive and more difficult to manufacture. Further, the movable electrical contact may cause failure of the switch after repeated usage. These are some of the problems this invention overcomes.

SUMMARY OF THE INVENTION

An electrical connector means for making or breaking an electrical connection includes an electrical contact means supported by a resiliently deformable support means so that a force applied to the electrical contact means causes deflection of the support means and applies a biasing force to the contact means. Thus, the electrical contact means is biased to press against a member applying the force and completes an electrical connection to the member.

In accordance with an embodiment of this invention, a relatively simple electrical connector means is utilized so that electrical power can be transmitted between two relatively movable body components. The electrical connector means can accommodate a wide variety of manufacturing variations and still satisfactorily complete an electrical connection. Further, positive electrical connection is obtained without the need for interlocking mechanical fasteners. Thus a potential source of failure is eliminated.

DETAILED DESCRIPTION OF THE INVENTION

Figure 1:
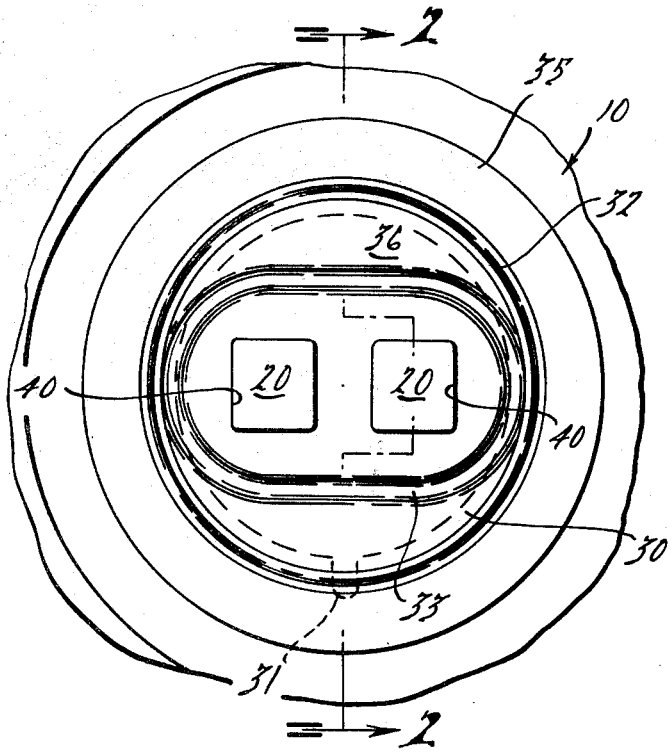
FIG. 1 is a top plan view of an electrical connector in accordance with an embodiment of this invention.

Referring to FIG. 1, a generally disc shaped electrical connector 10 has a resilient support means 30 for supporting a pair of spaced, electrical contacts 20. Electrical connector 10 can be used in combination with another such connector 10′ (see FIG. 4) so that opposing electrical contacts are biased toward one another to complete an electrical circuit. Support means 30 is typically made of a plastic or rubber material in a hollow disc shape and includes a central cavity 38 bounded by a top surface 36, a cylindrical side surface 37 and a bottom surface 39.

Figure 2:
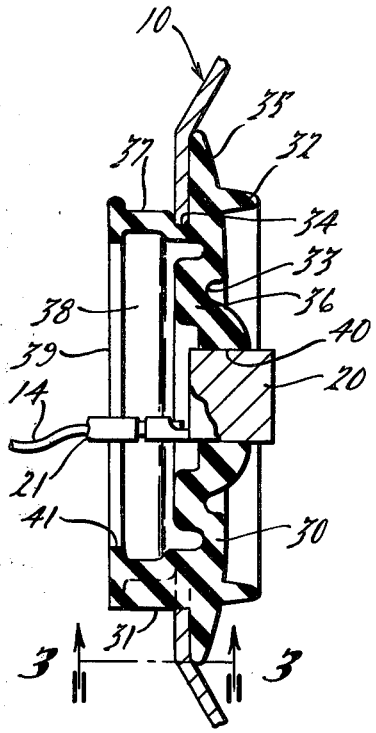
FIG. 2 is a sectional view taken generally along section line 2—2 of FIG. 1.

Referring to FIGS. 1 and 2, top surface 36 of the disc has two openings 40 for receiving contacts 20 surrounded by an annular deflection ridge 33 around both of electrical contacts 20. Deflection ridge 33 is an indentation into top surface 36 so that the portion within deflection ridge 33 can move in and out and thus move electrical contact 20. Top surface 36 includes a peripheral flange 35 which extends outwardly beyond cylindrical side surface 37. Adjacent peripheral flange 35 on side surface 37 is a circumferential mounting groove 34 which is adapted to receive the edge of a mounting opening in a car panel such as a door or body panel.

Figure 3:
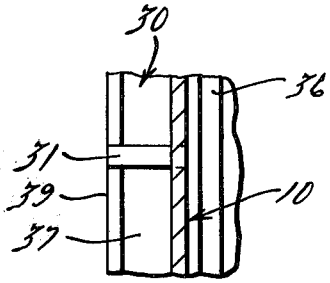
FIG. 3 is a partial side elevation view of a connector means generally along section line 3—3 of FIG. 2.
Figure 5:
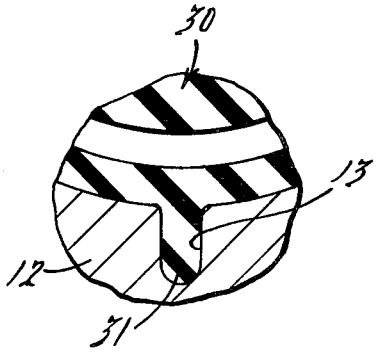
FIG. 5 is a sectional view along section line 5—5 of FIG. 4 including a location notch for positioning the electrical connector relative to the mounting panel.

Referring to FIGS. 3, and 5, side surface 37 includes a location notch or rib 31 which is generally perpendicular to bottom surface 39 of support means 30. Location notch or rib 31 is a protrusion from cylindrical side surface 37 and is received into an indentation or location notch 13 from a body panel thereby rotationally positioning the electrical connector 10 relative to a panel. Support means 30 further includes a sealing ridge 32 extending circumferentially around electrical contacts 20 radially outward of deflection ridge 33. Sealing ridge 32 is used to mate with another such sealing ridge or with a groove in an opposing electrical connector so that the portion of the electrical connector 10 inward of sealing ridge 32 is sealed from moisture and other undesirable elements.

Electrical connector 10 includes a pair of spaced, generally rectangular electrical contacts 20 received within a pair of spaced openings in top surface 36 of support means 30. Electrical contacts 20 extend into central cavity 38 and are sufficiently spaced from bottom surface 39 to permit deflection of top surface 36 so that central cavity 38 provides some clearance for movement of electrical socket 20. The rear surface of electrical contact 20 within central cavity 38 has protruding therefrom a socket 21. Socket 21 extends through an opening 41 in the bottom surface 39 of support means 30 and provides a coupling means for securing an electrical conductive wire 14 to electrical contact 20 (see FIG. 2). A typical material for electrical contacts 20 is a conductive metal such as aluminum, iron, copper or a combination.

Figure 4:
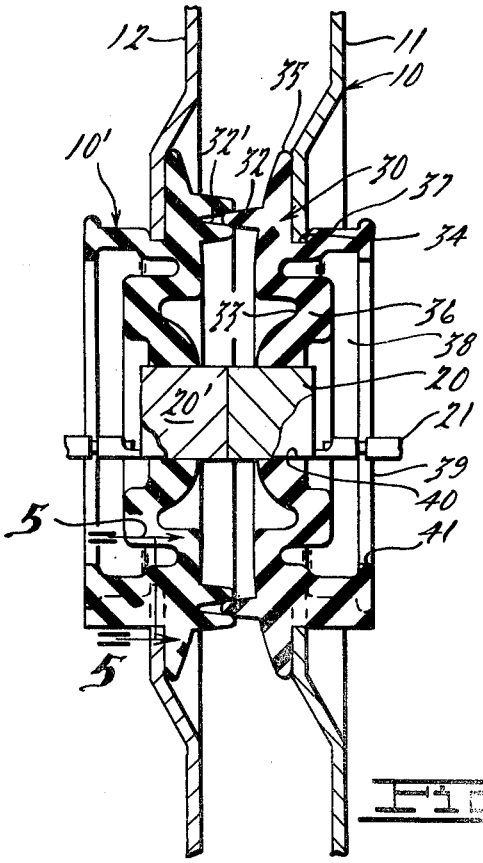
FIG. 4 is a sectional view of a pair of opposing connector means, when mounted in opposing mounting panel members of a car, the two connector means being positioned so as to be in electrical contact with each other.

Advantageously, electrical connector 10 is used in combination with electrical connector 10′ which is the same in all respect except that instead of a sealing ridge 32 there is a sealing groove 32′ which mates with sealing ridge 32 in a tongue in groove fashion (FIG. 4).

INSTALLATION AND OPERATION

To install electrical connector 10 in a door panel 11 and electrical connector 10′ in a body panel 12 (see FIG. 4) an opening is formed in panels 11 and 12 large enough to fit around the inside diameter of mounting groove 34. Additionally, the opening in the panels has a location notch 13, extending radially outward from the circular opening, which mates with location notch or rib 31. The use of location notch or rib 31 is advantageous because, as shown, electrical connector 10 has two electrical contacts 20 and each of the electrical contacts 20 in electrical 10 should mate with the corresponding electrical contacts 20′ in electrical connector 10′.

When electrical connectors 10 and 10′ are mounted, relative movement of door panel 11 and body panel 12 away from each other causes a break in the electrical connection between electrical contacts 20 and 20′. When door panel 11 is brought toward the body panel 12, electrical contacts 20 and 20′ abut one another to complete an electrical connection. Pressure of one electrical connector against another causes mating of sealing ridge 32 with sealing groove 32′ and seals the portion of top surface 36 radially inward of sealing ridge 32. Additionally, bringing panels 11 and 12 toward one another causes abutment of electrical contact 20 against electrical contact 20′ so that an electrical circuit is completed. Once electrical contacts 20 and 20′ are in contact, further movement of panel 11 and 12 toward each other causes deflection of top surface 36 along deflection ridge 36.

The front face of electrical contact 20 is made sufficiently large so that some misalignment between electrical connectors 10 and 10′ does not prevent contacts 20 and 20′ from touching and completing on electrical connection. Further, since there is no interlocking feature, repeated connections and disconnections only cause flexing of the electrical connectors which is relatively less likely to cause failure than the locking and unlocking of two components. When panels 11 and 12 are separated, electrical connector 20 does not present any sharp protrusions which would cause injury or damage. This is particularly important in a door or tailgate where there is a substantial amount of adjacent movement.

An electrical connector in accordance with the embodiment of this invention can advantageously be used in such applications as the tailgate of a station wagon wherein the operation of a power window is only desired when the tailgate is closed and there is contact. Similarly, the connection may be advantageously used in truck tailgates wherein the tailgate is completely removeable. Still further, the completion of electrical connection may be used to signal the closing of a passanger door which in turn may actuate a seat belt warning signal or an automatic seat belt apparatus.

Various alternate embodiments and variations would no doubt occur to those skilled in the art. For example, the particular shape and number of the contacts may be varied from that disclosed herein. These and all other variations which basically rely on the teachings through which this disclosure has advanced the art are properly considered within the scope of this invention.

The embodiments of the invention which an exclusive property or priviledge is claimed is defined as follows:

1. An electrical connector means for making and breaking an electrical connection including an electrical contact means for conducting electricity, said electrical contact means being supported by a resiliently deformable support means so that a force applied to said electrical contact means causes deflection of said support means and applies a biasing force to said contact means to resist the applied force so that said electrical contact means can form a pressing electrical connection;

said support means having a coupling means shaped to receive said contact means thereby coupling said electrical contact means to said support means, said support means being molded and shaped so there is a channel at least partially surrounding said contact means for permitting deflection of said support means thereby permitting movement of said contact means and for providing the biasing force resisting such movement;

said support means further including a sealing means for providing a water tight seal between said electrical connector means and another member to which contact is to be made, said sealing means including an annular ridge surrounding said electrical contact means; and said support means including a top surface, a bottom surface and a side surface thereby defining a cavity, said top surface including said coupling means and said channel so that said contact means can be moved into said cavity, said side surface including a mounting groove for receiving the edge of a panel member so that said electrical connector means can be attached to the panel member.

2. An electrical connector means as recited in claim 1 wherein said support means includes an alignment means for positioning said electrical connector means with respect to a member upon which said electrical connector is to be mounted;

said alignment means including a rib extending radially outward from a side of said support means;

said electrical connector means including at least two of said electrical contact means, and each of said electrical contact means including a socket means receiving an electrically conductive member, and said electrical contact means further including a generally flat contact face for use in forming a pressing electrical connection; and said sealing means being positioned outward of said mounting groove and spaced from said channel.

3. A pair of relatively movable electrical connector means for making and breaking an electrical connection including a first and a second electrical connector means movable toward one another for making an electrical connection and away from one another for breaking an electrical connection;

said first electrical connector means including a first electrical contact means and an associated first support means, said second electrical connector means including a second contact means and an associated second support means, each of said electrical contact means being electrically conductive and adapted to butt up against each other to make an electrical contact, each of said support means being molded and shaped so there is a channel at least partially surrounding said associated electrical contact means, for permitting deflection of said support means thereby permitting movement of said contact means and for providing a biasing force resisting such movement;

sealing means formed in each of said support means, said sealing means being spaced from the positioned outward of said channels away from said electrical contact means in each of said support means, said sealing means cooperating with each other to protect said electrical contact means;

mounting groove means formed in each of said support means so that said electrical connection means can be attached to the panel member;

said first and second electrical connector means being mounted so that said first and second electrical contact means are aligned when said first and second electrical connector means are brought toward one another; and said support means including a top surface spaced from a bottom surface and a side surface joining said top surface to said bottom surface thereby defining a cavity bounded by said top, bottom and side surfaces, said top surface including an opening for receiving said contact means so that said contact means is supported by said top surface and free to travel into said cavity.

* * * * *